US010543701B2

(12) United States Patent
Sawada et al.

(10) Patent No.: US 10,543,701 B2
(45) Date of Patent: Jan. 28, 2020

(54) THERMAL TRANSFER PRINTING APPARATUS AND THERMAL TRANSFER PRINTING METHOD

(71) Applicant: Dai Nippon Printing Co., Ltd., Tokyo (JP)

(72) Inventors: Koichi Sawada, Tokyo (JP); Noboru Kakihara, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 16/086,413

(22) PCT Filed: Mar. 27, 2017

(86) PCT No.: PCT/JP2017/012350

§ 371 (c)(1),
(2) Date: Sep. 19, 2018

(87) PCT Pub. No.: WO2017/208593

PCT Pub. Date: Dec. 7, 2017

(65) Prior Publication Data

US 2019/0092059 A1 Mar. 28, 2019

(30) Foreign Application Priority Data

Jun. 1, 2016 (JP) ..... 2016-110172

(51) Int. Cl.
*B41J 29/17* (2006.01)
*B41J 2/325* (2006.01)

(52) U.S. Cl.
CPC ..... *B41J 29/17* (2013.01); *B41J 2/325* (2013.01)

(58) Field of Classification Search
CPC . B41J 29/17; B41J 17/38; B41J 2/325; B41M 7/00; B41M 7/0009; B41M 7/009
See application file for complete search history.

(56) References Cited

U.S. PATENT DOCUMENTS 4,531,135 A 7/1985 Toshima
2002/0306986 12/2012 Bouverie et al.

FOREIGN PATENT DOCUMENTS

JP S60-009785 A1 1/1985
JP S63-254092 A1 10/1988
JP H05-058014 A1 3/1993
JP 2002-211064 A1 7/2002
JP 2005-014398 A1 1/2005
(Continued)

*Primary Examiner* — Kristal Feggins
(74) *Attorney, Agent, or Firm* — Burr & Brown, PLLC

(57) ABSTRACT

A thermal transfer printing apparatus including a feed roll feeding an ink ribbon during forward rotation, a thermal head performing a printing process that involves thermally transferring a color material onto first printing paper using the ink ribbon fed by the feed roll, and a recovery roll winding up the used ink ribbon during forward rotation, the used ink ribbon being the ink ribbon that has been subjected to the thermal transfer. After the feed roll and the recovery roll are rotated backward to rewind the used ink ribbon onto the feed roll, the used ink ribbon is fed from the feed roll and a color material is thermally transferred by the thermal head onto second printing paper based on a disturbance pattern. Because the disturbance pattern is superimposed on a residual image remaining on the ink ribbon, it is possible to prevent leakage of the residual image.

17 Claims, 5 Drawing Sheets

(56) References Cited

FOREIGN PATENT DOCUMENTS

| | | | |
|---|---|---|---|
| JP | 2007-090798 | A1 | 4/2007 |
| JP | 2008-087164 | A1 | 4/2008 |
| JP | 2008-114383 | A1 | 5/2008 |
| JP | 2013-202802 | A1 | 10/2013 |
| JP | 2013-202983 | A1 | 10/2013 |

Fig.3
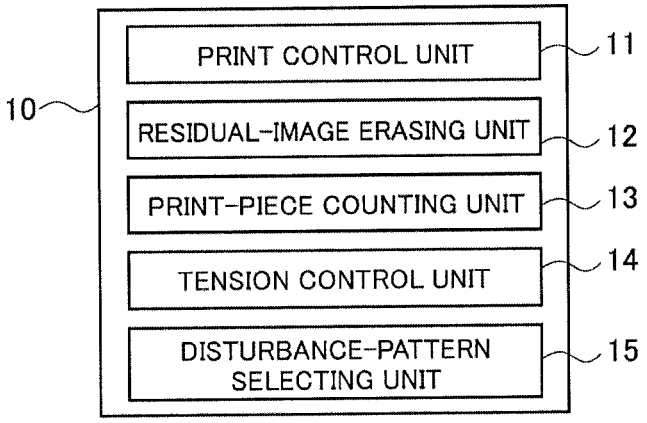
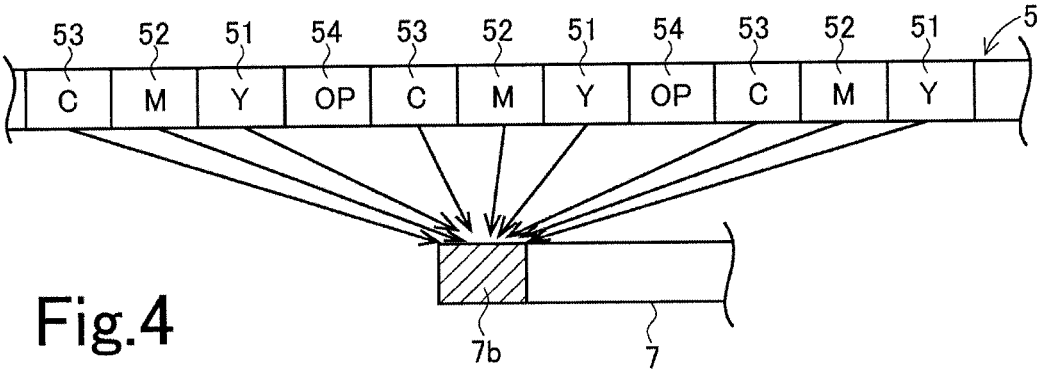
Fig.4

THERMAL TRANSFER PRINTING APPARATUS AND THERMAL TRANSFER PRINTING METHOD

TECHNICAL FIELD

The present invention relates to a thermal transfer printing apparatus and a thermal transfer printing method that prevent leakage of a residual image on a used ink ribbon.

BACKGROUND ART

Thermal transfer printers are known in which, with an ink ribbon and printing paper being sandwiched between a thermal head and a platen roll, the thermal head applies heat to the ink ribbon to transfer a dye from the ink ribbon onto the printing paper.

In the thermal transfer printers, the ink ribbon thus used in printing has a residual image thereon and information may leak therefrom. For example, in printers for commercial purposes, an ink ribbon used by customers is left inside the in-store printer. The used ink ribbon, which is simply placed inside the printer, can be easily accessed by an administrator of the printer. If the used ink ribbon is simply discarded, print information may leak to outsiders. To prevent leakage of information, the used ink ribbon is required to be subjected to appropriate measures.

For example, a thermal transfer system has been proposed, in which an outermost region of an ink ribbon wound around a take-up unit is fused to another region of the ink ribbon located inside the outermost region. With this thermal transfer system, different regions of the ink ribbon wound around the take-up unit after ink transfer can be joined together. This prevents leakage of printed text and image information from the ink ribbon from which ink has been transferred.

However, the thermal transfer system described above is costly, because it requires two transfer devices: a first transfer device configured to transfer ink from the ink ribbon onto printing paper to print text and images thereon; and a second transfer device disposed near the take-up unit for winding therearound the ink ribbon from which ink has been transferred (i.e., used ink ribbon), and configured to heat a region of the used ink ribbon to fuse it to another region of the used ink ribbon inside the heated region.

PTL 1: Japanese Unexamined Patent Application Publication No. 2013-202802

PTL 2: Japanese Unexamined Patent Application Publication No. 2005-14398

SUMMARY OF INVENTION

The present invention has been made in view of the conventional circumstances described above. An object of the present invention is to provide a thermal transfer printing apparatus and a thermal transfer printing method that can prevent leakage of a residual image on a used ink ribbon with a simple configuration at low cost.

According to the present invention, a thermal transfer printing apparatus includes a feed roll feeding an ink ribbon during forward rotation, a thermal head performing a printing process that involves thermally transferring a color material onto first printing paper using the ink ribbon fed by the feed roll, and a recovery roll winding up the used ink ribbon during forward rotation, the used ink ribbon being the ink ribbon that has been subjected to the thermal transfer, wherein after the feed roll and the recovery roll are rotated backward to rewind the used ink ribbon onto the feed roll, a residual-image erasing process is performed, in which the used ink ribbon is fed from the feed roll and a color material is thermally transferred by the thermal head onto second printing paper.

According to one aspect of the present invention, the residual-image erasing process is performed every time a printing process using a predetermined number of regions of the ink ribbon is performed, the region each corresponding to one screen.

According to one aspect of the present invention, the residual-image erasing process is performed after completion of a printing process for all regions of the ink ribbon.

According to one aspect of the present invention, the printing process uses a region of the ink ribbon, the region corresponding to one screen, to thermally transfer the color material onto the first printing paper corresponding to one screen, and the residual-image erasing process uses a plurality of regions of the ink ribbon, the regions each corresponding to one screen, to thermally transfer the color material onto the second printing paper corresponding to one screen.

According to one aspect of the present invention, the thermal transfer printing apparatus further includes a storage unit storing a plurality of pieces of disturbance pattern data. In the residual-image erasing process, the color material is thermally transferred from the used ink ribbon onto the second printing paper based on one of the plurality of pieces of disturbance pattern data.

According to one aspect of the present invention, the thermal transfer printing apparatus further includes a storage unit storing print density information for each region of the ink ribbon, the region corresponding to one screen, the print density information indicating a print density in the printing process. Energy used when the thermal head thermally transfers the color material onto the second printing paper is regulated based on the print density information.

According to one aspect of the present invention, the thermal transfer printing apparatus further includes a storage unit storing print density information for each region of the ink ribbon, the region corresponding to one screen, the print density information indicating a print density in the printing process, and a tension control unit controlling a tension applied from the feed roll or the recovery roll to the ink ribbon based on the print density information.

According to one aspect of the present invention, the thermal transfer printing apparatus further includes a tension control unit calculating a winding diameter of the feed roll or the recovery roll and controlling a tension applied from the feed roll or the recovery roll to the ink ribbon based on the winding diameter.

According to the present invention, a thermal transfer printing method includes feeding an ink ribbon by rotating a feed roll forward, performing a printing process that involves using a thermal head to thermally transfer a color material from the ink ribbon fed by the feed roll onto first printing paper, winding up the used ink ribbon by rotating a recovery roll forward, the used ink ribbon being the ink ribbon that has been subjected to the thermal transfer, rewinding the used ink ribbon onto the feed roll by rotating the feed roll and the recovery roll backward, feeding the used ink ribbon from the feed roll, and performing a residual-image erasing process that involves using the thermal head to thermally transfer the color material from the used ink ribbon fed by the feed roll onto second printing paper.

Advantageous Effects of Invention

The present invention prevents leakage of a residual image on a used ink ribbon with a simple configuration at low cost.

BRIEF DESCRIPTION OF DRAWINGS

FIG. 3 is a functional block diagram of a controller according to the embodiment.

FIG. 4 illustrates an example of how a print sheet is used in a residual-image erasing process.

DESCRIPTION OF EMBODIMENTS

Embodiments of the present invention will now be described on the basis of the drawings.

Figure 1:
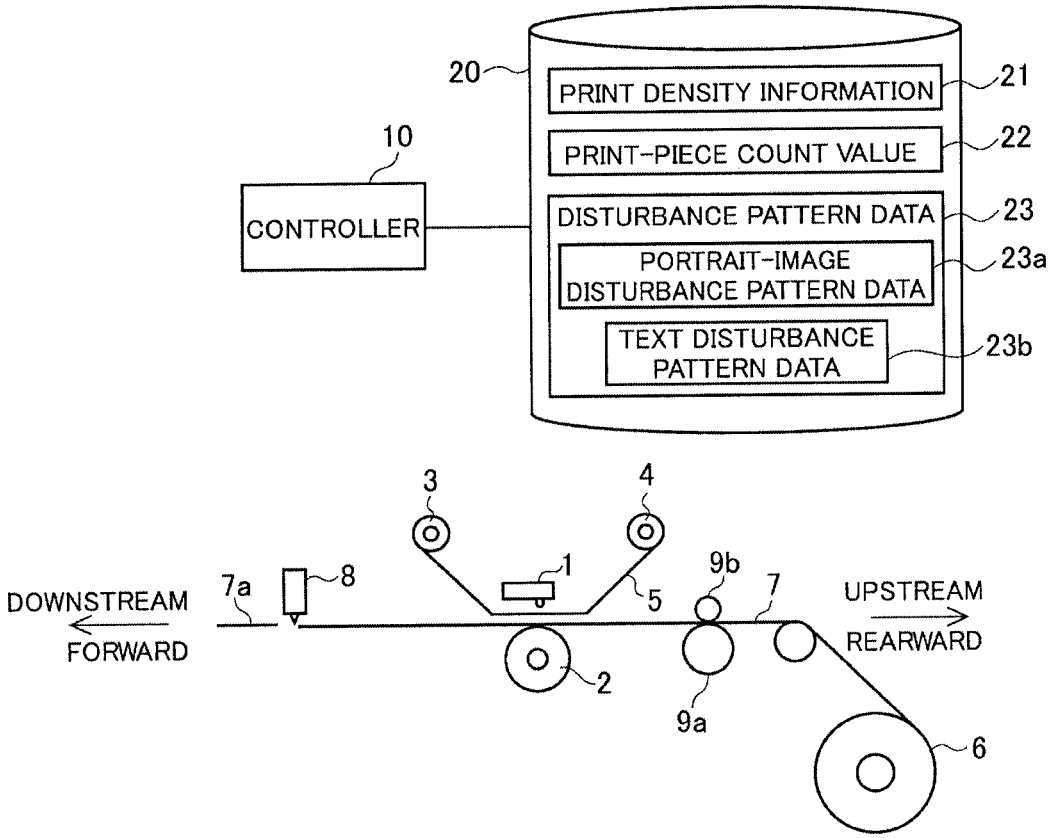
FIG. 1 is a schematic diagram of a thermal transfer printing apparatus according to an embodiment of the present invention.
Figure 2:
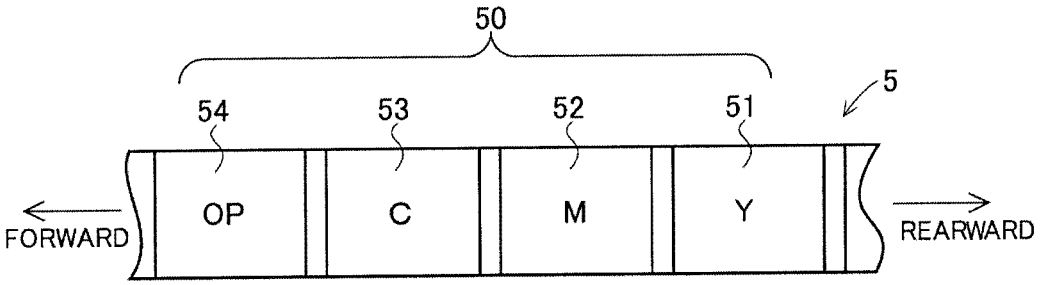
FIG. 2 is a plan view of an ink ribbon.

FIG. 1 is a schematic diagram of a thermal transfer printing apparatus according to an embodiment of the present invention, and FIG. 2 is a plan view of an ink ribbon used in the thermal transfer printing apparatus. The thermal transfer printing apparatus prints an image by sublimation transfer of yellow, magenta, and cyan dyes onto a print sheet (e.g., printing paper, image receiving paper). Examples of the image to be printed include portrait images, such as facial images, and text, such as names and addresses.

As illustrated in FIGS. 1 and 2, the thermal transfer printing apparatus includes a thermal head (printing unit) 1. By using an ink ribbon 5 having a Y layer 51 containing a yellow dye, an M layer 52 containing a magenta dye, a C layer 53 containing a cyan dye, and a surface protection or over print (OP) layer 54 which are frame-sequentially arranged, the thermal head 1 prints an image by sublimation transfer of Y, M, and C dyes onto a print sheet 7 and then forms a protective layer on the image.

An ink ribbon feed roll 3 having the ink ribbon 5 wound therearound is disposed downstream of the thermal head 1, and an ink ribbon recovery roll 4 is disposed upstream of the thermal head 1. The ink ribbon 5 fed out by forward rotation of the ink ribbon feed roll 3 passes through the thermal head 1 and is collected by the ink ribbon recovery roll 4 rotating forward.

The ink ribbon feed roll 3 and the ink ribbon recovery roll 4 are capable of rotating backward. By backward rotation of the ink ribbon feed roll 3 and the ink ribbon recovery roll 4, the ink ribbon 5 from which ink has been transferred (i.e., used ink ribbon 5) is wound up onto the ink ribbon feed roll 3.

A rotatable platen roll 2 is disposed below the thermal head 1. A capstan roller 9*a* capable of being rotationally driven to convey the print sheet 7 and a pinch roller 9*b* for pressing the print sheet 7 against the capstan roller 9*a* are disposed upstream of the thermal head 1.

The ink ribbon 5 has, on one side thereof, the Y layer 51, the M layer 52, the C layer 53, and the OP layer 54 sequentially formed from the side of the ink ribbon recovery roll 4. In other words, a plurality of dye layer sets 50, each including the Y layer 51, the M layer 52, the C layer 53, and the OP layer 54 (which correspond to one screen), are sequentially arranged. A material used to form the Y layer 51, the M layer 52, and the C layer 53 is preferably one that is produced by fusing or dispersing a sublimation dye into binder resin. A transparent, adhesive, and light-resistant material is preferably used to form the OP layer 54.

The print sheet 7 is wound around a printing paper roll 6 and fed out from the printing paper roll 6. A sheet of a known type may be used as the print sheet 7.

The thermal transfer printing apparatus includes a controller 10 that controls the drive of each part, and a storage unit 20 that stores various types of data. As illustrated in FIG. 3, the controller 10 includes a print control unit 11, a residual-image erasing unit 12, a print-piece counting unit 13, a tension control unit 14, and a disturbance-pattern selecting unit 15.

Each part of the controller 10 may be configured either by hardware or software. When configured by software, a program that implements at least part of the function of the controller 10 may be stored in a recording medium, such as a CD-ROM, and read and executed by a computer.

The thermal transfer printing apparatus according to the present embodiment performs a printing process that thermally transfers color materials (dyes) from the ink ribbon 5 onto the print sheet 7 to form an image thereon, and a residual-image erasing process that thermally transfers the color materials remaining on the ink ribbon 5 after the thermal transfer (i.e., on the used ink ribbon 5) onto the print sheet 7 to erase (or make unreadable) the residual image on the used ink ribbon.

The print control unit 11 controls the drive of each part of the thermal transfer printing apparatus to perform a printing process. In the printing process, first, the print sheet 7 and the Y layer 51 are aligned, and the thermal head 1 is brought into contact with the platen roll 2, with the print sheet 7 and the ink ribbon 5 interposed therebetween. Next, the capstan roller 9*a* and the ink ribbon recovery roll 4 are rotationally driven to move the print sheet 7 and the ink ribbon 5 rearward. During this operation, on the basis of image data, different regions of the Y layer 51 are selectively sequentially heated by the thermal head 1, and Y is sublimation-transferred from the ink ribbon 5 onto the print sheet 7.

After the sublimation transfer of Y, the thermal head 1 is lifted away from the platen roll 2. Next, the print sheet 7 and the M layer 52 are aligned. In this case, the print sheet 7 is moved forward by a distance equivalent to the print size, whereas the ink ribbon 5 is moved rearward by a distance equivalent to the margin between the Y layer 51 and the M layer 52.

In the same manner as when Y is sublimation-transferred, M and C are sequentially sublimation-transferred onto the print sheet 7 to form an image on the print sheet 7. Next, the thermal head 1 transfers the OP layer 54 over the entire image to form a protective layer thereon. The used ink ribbon 5 is wound up onto the ink ribbon recovery roll 4.

Then, on the downstream side, a cutter 8 cuts off a print piece 7*a* from the print sheet 7. The print piece 7*a* is discharged from a discharge port (not shown). The printing process uses one dye layer set 50 to transfer color materials onto a portion of the print sheet 7 corresponding to one screen (one print piece 7*a*) to form an image thereon.

The print control unit 11 generates print density information 21 indicating the level of density (energy) used for printing of each of the Y layer 51, the M layer 52, and the C layer 53, and stores the generated print density information 21 in the storage unit 20. The print density information 21 is generated for each dye layer set 50 of the used ink ribbon 5 (i.e., generated for each screen). The print-piece counting unit 13 counts the number of print pieces 7a (i.e., the number of screens) and updates a print-piece count value 22 in the storage unit 20.

Every time a printing process for a predetermined number of print pieces 7a (e.g., 20 print pieces 7a) is performed, the residual-image erasing unit 12 controls each part of the thermal transfer printing apparatus to perform a residual-image erasing process. The residual-image erasing unit 12 starts the residual-image erasing process when the print-piece count value in the storage unit 20 reaches a predetermined value.

In the residual-image erasing process, first, the ink ribbon feed roll 3 and the ink ribbon recovery roll 4 are rotated backward, and the used ink ribbon 5 wound around the ink ribbon recovery roll 4 is rewound toward the ink ribbon feed roll 3. The used ink ribbon 5 is rewound by a length corresponding to a predetermined number of dye layer sets 50 (e.g., 20 dye layer sets 50).

Next, the print sheet 7 and the Y layer 51 which has been subjected to transfer are aligned, and the thermal head 1 is brought into contact with the platen roll 2, with the print sheet 7 and the ink ribbon 5 interposed therebetween. Next, the capstan roller 9a and the ink ribbon recovery roll 4 are rotationally driven to move the print sheet 7 and the ink ribbon 5 rearward. During this operation, on the basis of disturbance pattern data 23 stored in the storage unit 20, different regions of the used Y layer 51 (from which the color material has been transferred) are selectively sequentially heated by the thermal head 1, and Y is sublimation-transferred from the ink ribbon 5 onto the print sheet 7.

After the sublimation transfer of Y, the thermal head 1 is lifted away from the platen roll 2. Next, the print sheet 7 and the M layer 52 which has been subjected to transfer are aligned. In this case, the print sheet 7 is moved forward by a distance equivalent to the print size, whereas the ink ribbon 5 is moved rearward by a distance equivalent to the margin between the Y layer 51 and the M layer 52.

In the same manner as for the sublimation transfer of Y, on the basis of the disturbance pattern data 23, M and C are sequentially sublimation-transferred from the used M layer 52 and C layer 53 onto the print sheet 7 to form a disturbance pattern on the print sheet 7. After the transfer of the disturbance pattern, the ink ribbon 5 is wound up onto the ink ribbon recovery roll 4 again.

The transfer of the disturbance pattern described above is performed for the rewound used ink ribbon 5. In the residual-image erasing process, as illustrated in FIG. 4, the disturbance pattern is transferred onto a print sheet segment 7b corresponding to one screen by using the Y layers 51, the M layers 52, and the C layers 53 of the plurality of used dye layer sets 50 (corresponding to a plurality of screens). This can reduce use of the print sheet 7 associated with the residual-image erasing process. The print sheet segment 7b (corresponding to one screen) onto which the disturbance pattern has been transferred multiple times is cut off by the cutter 8 and discarded.

After the first transfer (i.e., transfer in the printing process), a residual image corresponding to image data remains on the ink ribbon 5. In the residual-image erasing process, a disturbance pattern is transferred using the used ink ribbon 5. After the second transfer (i.e., transfer in the residual-image erasing process), the resulting residual image on the ink ribbon 5 is an image having the disturbance pattern superimposed thereon. The residual image remaining on the used ink ribbon can thus be erased (or made unreadable).

The disturbance pattern data 23 includes portrait-image disturbance pattern data 23a and text disturbance pattern data 23b. For example, the portrait-image disturbance pattern data 23a is checkered pattern data, and the text disturbance pattern data 23b is random text data. A disturbance pattern produced by combining the portrait-image disturbance pattern data 23a and the text disturbance pattern data 23b may be used.

In the residual-image erasing process, the disturbance-pattern selecting unit 15 receives a user's selection of one of the portrait-image disturbance pattern data 23a and the text disturbance pattern data 23b. On the basis of the disturbance pattern data selected, the thermal head 1 heats the used Y layer 51, M layer 52, and the C layer 53.

The residual-image erasing unit 12 refers to the print density information 21 to estimate the amount of dyes remaining on the used ink ribbon 5 and the degree of damage to the used ink ribbon 5, and regulates the level of energy applied to the thermal head 1 when the disturbance pattern is transferred. This can prevent excessive damage to the ink ribbon 5.

The tension control unit 14 calculates the winding diameters of the ink ribbon feed roll 3 and the ink ribbon recovery roll 4 in the printing process, and also calculates the winding diameters of the ink ribbon feed roll 3 and the ink ribbon recovery roll 4 on the basis of the amount by which the used ink ribbon 5 is rewound. From the calculated winding diameters, the tension control unit 14 regulates a voltage applied to a motor (not shown) connected to the ink ribbon feed roll 3 and the ink ribbon recovery roll 4 and applies an appropriate tension to the ink ribbon 5. The tension control unit 14 may estimate the degree of damage to the used ink ribbon 5 on the basis of the print density information 21, and regulate the voltage applied to the motor in such a manner that the tension is applied appropriately depending on the degree of damage. This can prevent the ink ribbon 5 from breaking.

After the residual-image erasing process, the print-piece counting unit 13 resets the print-piece count value 22 in the storage unit 20 and the printing process starts again. The print density information 21 for a portion of the ink ribbon 5 (i.e., dye layer sets 50) that has been subjected to the residual-image erasing process may be deleted.

Figure 5:
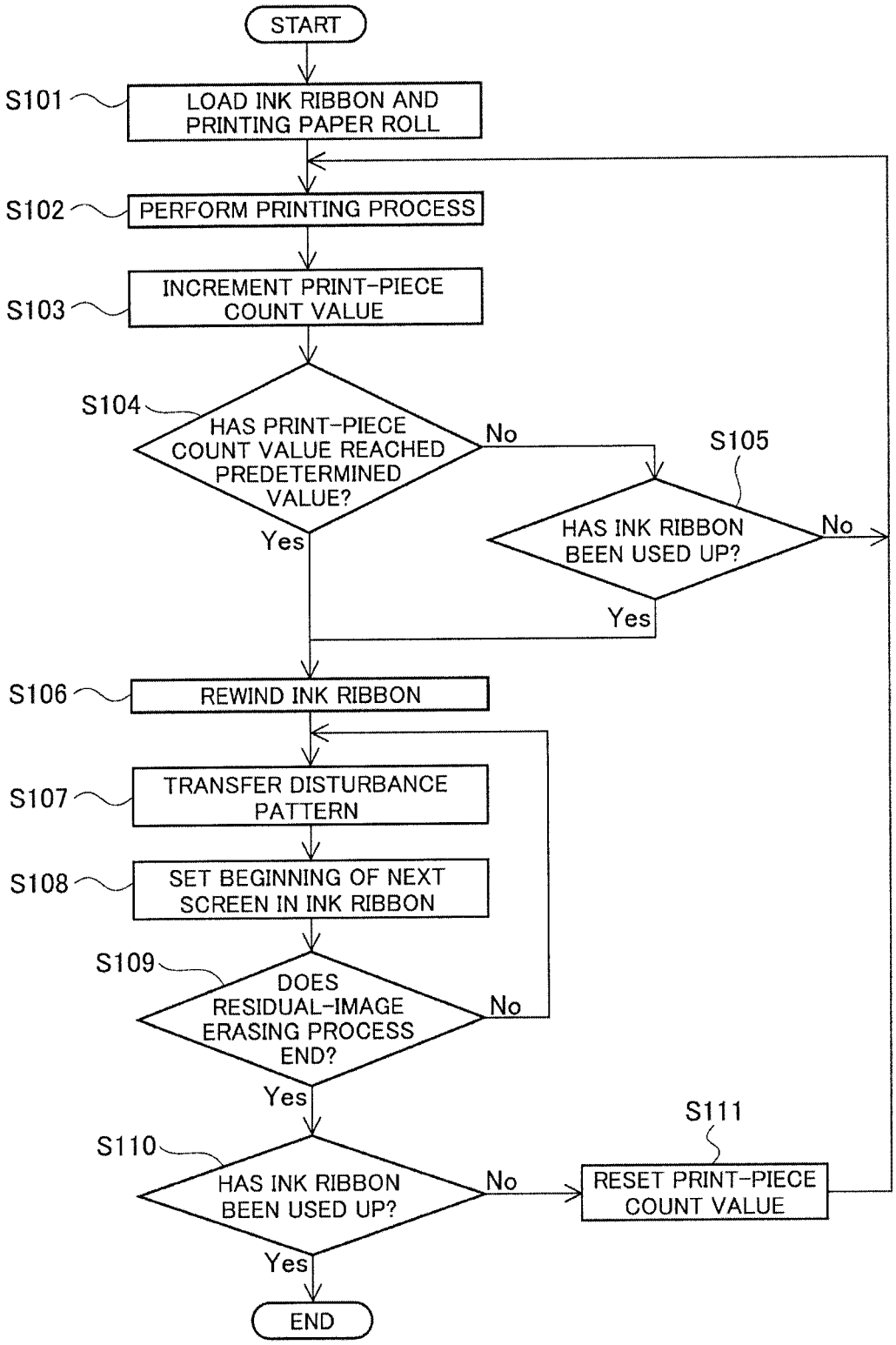
FIG. 5 is a flowchart illustrating a thermal transfer printing method according to the embodiment.

A thermal transfer printing method using this thermal transfer printing apparatus will now be described with reference to the flowchart of FIG. 5. First, the ink ribbon 5 and the printing paper roll 6 which are unused are loaded in the thermal transfer printing apparatus (step S101).

The print control unit 11 controls the drive of each part of the thermal transfer printing apparatus to perform a printing process (step S102). By using one dye layer set 50, the thermal head 1 sequentially transfers Y, M, and C onto the print sheet 7 to form an image thereon on the basis of image data, and forms a protective layer on the image. Then, the print piece 7a is cut off. After printing of one print piece 7a, the print-piece count value 22 is incremented.

If the print-piece count value is below a predetermined value (NO in step S104) and the ink ribbon 5 has not been used up (NO in step S105), the printing process for the next screen starts.

If the print-piece count value reaches the predetermined value (YES in step S104), a residual-image erasing process starts. Even when the print-piece count value is below the predetermined value (NO in step S104), if the ink ribbon 5 has been used up (YES in step S105), the residual-image erasing process starts in the same manner as above.

At the start of the residual-image erasing process, first, the ink ribbon feed roll 3 and the ink ribbon recovery roll 4 are rotated backward, and the used ink ribbon 5 used in the printing process for the predetermined number of sheets (print pieces) is rewound toward the ink ribbon feed roll 3 (step S106).

The ink ribbon feed roll 3 and the ink ribbon recovery roll 4 are then rotated forward. On the basis of disturbance pattern data, the thermal head 1 heats the used Y layer 51, M layer 52, and C layer 53 to sequentially transfer Y, M, and C onto the print sheet 7 (step S107).

By the transfer of the disturbance pattern, a residual image remaining on the ink ribbon 5 in the printing process in step S102 can be made unreadable, because the disturbance pattern is superimposed on the residual image.

The beginning of the next dye layer set 50, which corresponds to the next screen, is located in the ink ribbon 5 (step S108). Transfer of the disturbance pattern is performed for all the rewound used regions of the ink ribbon 5. For transfer of the disturbance pattern from a plurality of dye layer sets 50, the print sheet segment 7*b* corresponding to one screen (see FIG. 4) is repeatedly used.

When transfer of the disturbance pattern for all the rewound used regions of the ink ribbon 5 has been completed, the residual-image erasing process ends (YES in step S109). If any region of the ink ribbon 5 is left unused (NO in step S110), the print-piece count value 22 is reset (step S111) and the printing process is started again.

In the present embodiment, as described above, the thermal head 1 heats the ink ribbon 5 on the basis of image data to form an image on the print sheet 7, and heats the used ink ribbon 5 on the basis of disturbance pattern data to perform a residual-image erasing process. This can reduce cost, because no additional transfer mechanism is required to erase the residual image.

Since the print sheet segment 7*b* corresponding to one screen (see FIG. 4) is repeatedly used for transfer of the disturbance pattern from the plurality of dye layer sets 50, the cost of printing paper can be reduced.

The embodiment described above has dealt with an example in which a residual-image erasing process is performed every time a printing process for a predetermined number of print pieces 7*a* (or screens) is performed. Alternatively, a residual-image erasing process may be performed for the entire used ink ribbon 5 after the ink ribbon 5 is used up. This thermal transfer printing method will be described using the flowchart of FIG. 6. First, the ink ribbon 5 and the printing paper roll 6 which are unused are loaded in the thermal transfer printing apparatus (step S201).

The print control unit 11 controls the drive of each part of the thermal transfer printing apparatus to perform a printing process (step S202). The printing process continues until the ink ribbon 5 is used up (i.e., until all regions of the ink ribbon 5 are used and no region of the ink ribbon 5 is left unused).

After the ink ribbon 5 is used up (YES in step S203), a residual-image erasing process starts. At the start of the residual-image erasing process, first, the ink ribbon feed roll 3 and the ink ribbon recovery roll 4 are rotated backward to rewind the entire used ink ribbon 5 toward the ink ribbon feed roll 3 (step S204).

The ink ribbon feed roll 3 and the ink ribbon recovery roll 4 are then rotated forward to feed the used ink ribbon 5 from the ink ribbon feed roll 3. On the basis of disturbance pattern data, the thermal head 1 heats the used Y layer 51, M layer 52, and C layer 53 to sequentially transfer the Y, M, and C onto the print sheet 7 (step S205).

The beginning of the next dye layer set 50, which corresponds to the next screen, is located in the ink ribbon 5 (step S206). The process ends when transfer of the disturbance pattern is performed for the entire used ink ribbon 5 rewound (YES in step S207).

Figure 6:
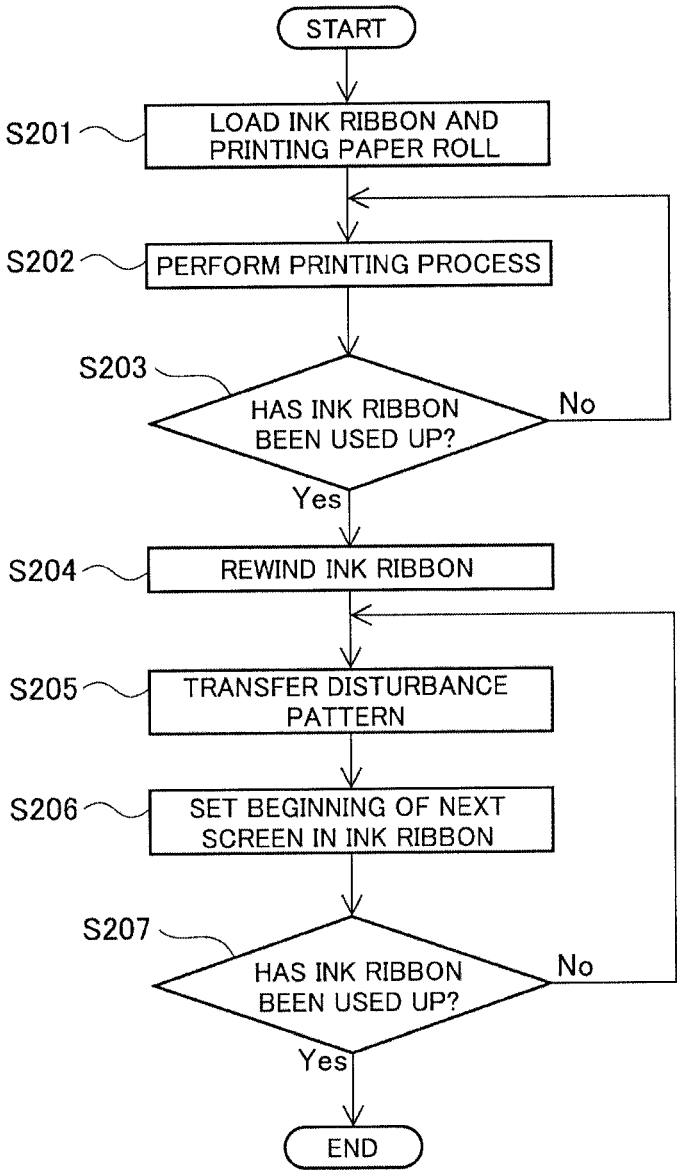
FIG. 6 is a flowchart illustrating a thermal transfer printing method according to another embodiment.

In the flow illustrated in FIG. 6, rewinding the used ink ribbon 5 toward the ink ribbon feed roll 3 is followed by rotating the ink ribbon feed roll 3 and the ink ribbon recovery roll 4 forward to transfer the disturbance pattern. Alternatively, the disturbance pattern may be transferred while the used ink ribbon 5 is being rewound toward the ink ribbon feed roll 3. In this case, the ink ribbon 5 is rewound onto the ink ribbon feed roll 3 after being subjected to the residual-image erasing process which involves transfer of the disturbance pattern.

Figure 7:
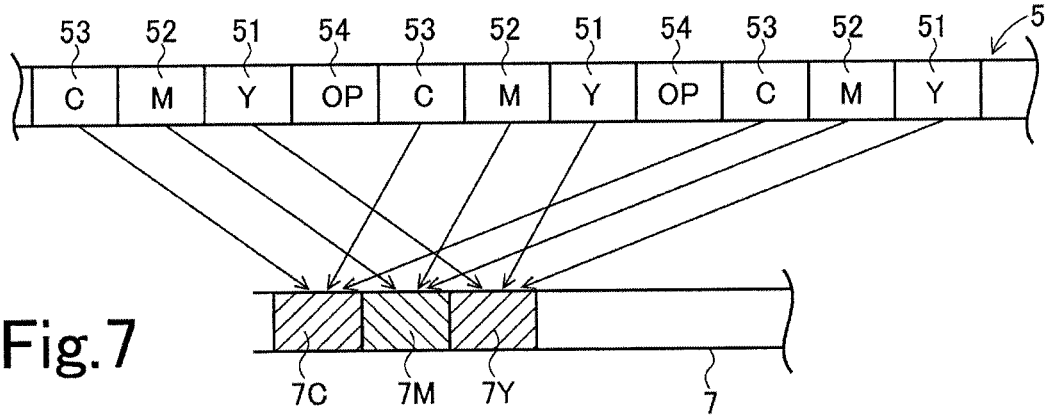
FIG. 7 illustrates another example of how a print sheet is used in the residual-image erasing process.

In the embodiments described above, as illustrated in FIG. 4, the print sheet segment 7*b* corresponding to one screen is used for transfer of the disturbance pattern from a plurality of dye layer sets 50. Alternatively, as illustrated in FIG. 7, print sheet segments 7Y, 7M, and 7C corresponding to three screens may be used so that the disturbance pattern from a plurality of used Y layers 51, M layers 52, and C layers 53 is transferred onto the print sheet segments 7Y, 7M, and 7C. Although this increases the use of the print sheet, the number of times the thermal head 1 is moved up and down is reduced, and thus the time required for the residual-image erasing process can be reduced.

If a color material can be transferred onto the protective layer in the embodiments described above, the disturbance pattern may be transferred using the OP layer 54 and the residual-image erasing process may be performed for the OP layer 54.

While the present invention has been described in detail using specific embodiments, it is obvious to those skilled in the art that various changes can be made without departing from the spirit and scope of the present invention.

The present application is based on Japanese Patent Application No. 2016-110172 filed Jun. 1, 2016, which is hereby incorporated by reference herein in its entirety.

The invention claimed is:

1. A thermal transfer printing apparatus comprising:

a feed roll feeding an ink ribbon during forward rotation;

a thermal head performing a printing process that involves thermally transferring a color material onto a first printing paper using the ink ribbon fed by the feed roll;

a recovery roll winding up the used ink ribbon during forward rotation, the used ink ribbon being the ink ribbon that has been subjected to the thermal transfer; and a storage unit storing a plurality of pieces of disturbance pattern data, wherein after the feed roll and the recovery roll are rotated backward to rewind the used ink ribbon onto the feed roll, a residual-image erasing process is performed, in which the used ink ribbon is fed from the feed roll and a color material is thermally transferred by the thermal head onto a second printing paper, wherein in the residual-image erasing process, the color material is thermally transferred from the used ink ribbon onto the second printing paper based on one of the plurality of pieces of disturbance pattern data, and the plurality of pieces of disturbance pattern data include portrait-image disturbance pattern data and text disturbance pattern data.

2. The thermal transfer printing apparatus according to claim 1, wherein the residual-image erasing process is performed every time a printing process using a predetermined number of regions of the ink ribbon is performed, each of the regions corresponding to one screen.

3. The thermal transfer printing apparatus according to claim 1, wherein the residual-image erasing process is performed after completion of the printing process for all regions of the ink ribbon.

4. The thermal transfer printing apparatus according to claim 1, wherein the printing process uses a region of the ink ribbon, the region corresponding to one screen, to thermally transfer the color material onto the first printing paper corresponding to one screen; and the residual-image erasing process uses a plurality of regions of the ink ribbon, each of the regions corresponding to one screen, to thermally transfer the color material onto the second printing paper corresponding to the one screen.

5. The thermal transfer printing apparatus according to claim 1, wherein the storage unit further stores print density information for each region of the ink ribbon, the region corresponding to one screen, the print density information indicating a print density in the printing process, wherein energy used when the thermal head thermally transfers the color material onto the second printing paper is regulated based on the print density information.

6. The thermal transfer printing apparatus according to claim 1, wherein the storage unit further stores print density information for each region of the ink ribbon, the region corresponding to one screen, the print density information indicating a print density in the printing process; and a tension control unit controls a tension applied from the feed roll or the recovery roll to the ink ribbon based on the print density information.

7. The thermal transfer printing apparatus according to claim 1, further comprising a tension control unit calculating a winding diameter of the feed roll or the recovery roll and controlling a tension applied from the feed roll or the recovery roll to the ink ribbon based on the winding diameter.

8. The thermal transfer printing apparatus according to claim 1, wherein the residual-image erasing process is performed every time a printing process using a predetermined number of regions of the ink ribbon is performed, the region each corresponding to one screen, the printing process uses a region of the ink ribbon, the region corresponding to one screen, to thermally transfer the color material onto the first printing paper corresponding to the one screen, and the residual-image erasing process uses a plurality of regions of the ink ribbon, each of the regions corresponding to one screen, to thermally transfer the color material onto the second printing paper corresponding to the one screen.

9. The thermal transfer printing apparatus according to claim 1, wherein the residual-image erasing process is performed after completion of a printing process for all regions of the ink ribbon, the printing process uses a region of the ink ribbon, the region corresponding to one screen, to thermally transfer the color material onto the first printing paper corresponding to one screen, and the residual-image erasing process uses a plurality of regions of the ink ribbon, each of the regions corresponding to one screen, to thermally transfer the color material onto the second printing paper corresponding to the one screen.

10. The thermal transfer printing apparatus according to claim 1, wherein the storage unit further stores print density information for each region of the ink ribbon, the region corresponding to one screen, the print density information indicating a print density in the printing process, wherein energy used when the thermal head thermally transfers the color material onto the second printing paper is regulated based on the print density information, and the residual-image erasing process is performed every time a printing process using a predetermined number of regions of the ink ribbon is performed, each of the regions corresponding to one screen.

11. The thermal transfer printing apparatus according to claim 1, wherein the storage unit further stores print density information for each region of the ink ribbon, the region corresponding to one screen, the print density information indicating a print density in the printing process, wherein energy used when the thermal head thermally transfers the color material onto the second printing paper is regulated based on the print density information, and the residual-image erasing process is performed after completion of a printing process for all regions of the ink ribbon.

12. The thermal transfer printing apparatus according to claim 1, wherein the storage unit further stores print density information for each region of the ink ribbon, the region corresponding to one screen, the print density information indicating a print density in the printing process;

a tension control unit controls a tension applied from the feed roll or the recovery roll to the ink ribbon based on the print density information, and the residual-image erasing process is performed every time a printing process using a predetermined number of regions of the ink ribbon is performed, the region each corresponding to one screen.

13. The thermal transfer printing apparatus according to claim 1, wherein the storage unit further stores print density information for each region of the ink ribbon, the region corresponding to one screen, the print density information indicating a print density in the printing process;

a tension control unit controls a tension applied from the feed roll or the recovery roll to the ink ribbon based on the print density information, and the residual-image erasing process is performed after completion of a printing process for all regions of the ink ribbon.

14. The thermal transfer printing apparatus according to claim 1, further comprising a tension control unit calculating a winding diameter of the feed roll or the recovery roll and controlling a tension applied from the feed roll or the recovery roll to the ink ribbon based on the winding diameter, wherein the residual-image erasing process is performed every time a printing process using a predetermined number of regions of the ink ribbon is performed, each of the regions corresponding to one screen.

15. The thermal transfer printing apparatus according to claim 1, further comprising a tension control unit calculating a winding diameter of the feed roll or the recovery roll and controlling a tension applied from the feed roll or the recovery roll to the ink ribbon based on the winding diameter, wherein the residual-image erasing process is performed after completion of a printing process for all regions of the ink ribbon.

16. The thermal transfer printing apparatus according to claim 1, wherein the portrait-image disturbance pattern data is checkered pattern data, and the text disturbance pattern data is random text data.

17. A thermal transfer printing method comprising:

feeding an ink ribbon by rotating a feed roll forward;

performing a printing process that involves using a thermal head to thermally transfer a color material from the ink ribbon fed by the feed roll onto a first printing paper;

winding up the used ink ribbon by rotating a recovery roll forward, the used ink ribbon being the ink ribbon that has been subjected to the thermal transfer;

rewinding the used ink ribbon onto the feed roll by rotating the feed roll and the recovery roll backward;

feeding the used ink ribbon from the feed roll; and performing a residual-image erasing process that involves using the thermal head to thermally transfer the color material from the used ink ribbon fed by the feed roll onto a second printing paper, wherein in the residual-image erasing process, the color material is thermally transferred from the used ink ribbon onto the second printing paper based on one of a plurality of pieces of disturbance pattern data, and the plurality of pieces of disturbance pattern data include portrait-image disturbance pattern data and text disturbance pattern data.

* * * * *